US011212620B2

(12) United States Patent
Chen et al.

(10) Patent No.: US 11,212,620 B2
(45) Date of Patent: Dec. 28, 2021

(54) SCREEN SOUNDING DEVICE

(71) Applicant: AAC Technologies Pte. Ltd., Singapore (SG)

(72) Inventors: Zhaoxian Chen, Shenzhen (CN); Lubin Mao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 1 day.

(21) Appl. No.: 16/996,938

(22) Filed: Aug. 19, 2020

(65) Prior Publication Data

US 2020/0396544 A1 Dec. 17, 2020

Related U.S. Application Data

(63) Continuation of application No. PCT/CN2019/091234, filed on Jun. 14, 2019.

(30) Foreign Application Priority Data

Jun. 12, 2019 (CN) ..... 201910507065.8

(51) Int. Cl.

| | |
|---|---|
| ***H04R 1/02*** | (2006.01) |
| ***H04R 9/06*** | (2006.01) |
| ***H04R 9/02*** | (2006.01) |
| ***H04R 7/04*** | (2006.01) |

(52) U.S. Cl.

CPC ..... *H04R 9/06* (2013.01); *H04R 1/028* (2013.01); *H04R 7/04* (2013.01); *H04R 9/025* (2013.01); *H04R 2499/15* (2013.01)

(58) Field of Classification Search

CPC ..... H04R 1/02

See application file for complete search history.

(56) References Cited

U.S. PATENT DOCUMENTS

| | | | | |
|---|---|---|---|---|
| 9,955,251 | B1 * | 4/2018 | Zu | H04R 31/00 |
| 2009/0097692 | A1 * | 4/2009 | Sakamoto | H04R 7/045 381/388 |
| 2014/0185859 | A1 * | 7/2014 | Wilk | H04R 9/025 381/412 |

* cited by examiner

*Primary Examiner* — Olisa Anwah

(74) *Attorney, Agent, or Firm* — W&G Law Group

(57) ABSTRACT

The present invention discloses a screen sounding device, including a screen, a frame and an electromagnetic driving module. The electromagnetic driving module includes an electromagnet, a magnetic conduction base and a magnetic conduction covering plate. The strength of the driving force can be controlled by changing the magnitude of the electric current flowing into the coil, which can provide a greater driving force to obtain a better sound effect. In addition, the driving module of the present invention has a simple structure and can be easily installed; the vibration amplitude of the screen is small, and the sounding device can be made thinner and smaller; compared with the traditional speaker and receiver, the structure such as the diaphragm is omitted, and the manufacturing cost is lower.

12 Claims, 4 Drawing Sheets

SCREEN SOUNDING DEVICE

FIELD OF THE PRESENT DISCLOSURE

The invention relates to the field of electroacoustic conversion technology, especially relating to a screen sounding device.

DESCRIPTION OF RELATED ART

With the rapid development of technology, more and more electronic devices are equipped with acoustic functions. However, the acoustic function of the electronic device is realized through sounding device. Many electronic devices have multiple functions such as video playback, music playback and navigation prompts, etc. in order to be easily controlled and carried. Electronic devices are being developed in a more refined trend. However, the more electronic components disposed in the sounding device results in less reliable.

For example, the driving unit used in the sounding device of the existing mobile phone is classified into a piezoelectric type and a moving coil type. The sounding device is inside the entire mobile phone and connects the mobile phone middle frame (or back cover) and the mobile phone screen as a whole device or a distributed device. However, using a driving device of piezoelectric type requires a larger voltage. The moving coil type driving device has a complicated structure and the size of the sounding device is difficult to be made smaller. And the driving force is limited. As a result, the sound performance is not so good.

SUMMARY OF THE INVENTION

One of the major objects of the present invention is to provide a screen sounding device having simplified structure, greater driving force and improved sound performance.

In order to achieve the object mentioned above, the present invention provides a screen sounding device, including a screen, a frame and an electromagnetic driving module. The electromagnetic driving module includes an electromagnet, a magnetic conduction base and a magnetic conduction covering plate. The strength of the driving force can be controlled by changing the magnitude of the electric current flowing into the coil, which can provide a greater driving force to obtain a better sound effect. In addition, the driving module of the present invention has a simple structure and can be easily installed; the vibration amplitude of the screen is small, and the sounding device can be made thinner and smaller; compared with the traditional speaker and receiver, the structure such as the diaphragm is omitted, and the manufacturing cost is lower.

As an improvement, the electromagnetic driving module includes a connection plate stacked on the second connection part of the magnetic conduction covering plate and fixedly connected to the screen.

As an improvement, the magnetic conduction base includes multiple side walls collectively surrounding and forming the cavity, and a gap is arranged between an inner side surface of the side wall and the coil.

As an improvement, the screen sounding device further includes multiple deformation spaces communicated with each other and located between an inner side surface of the first connection part and an outer periphery of the second connection part, wherein each of the deformation space accommodates one spring force arm.

As an improvement, the spring force arm is in a striped shape having two ends thereof respectively placed at diagonal positions of the deformation space.

As an improvement, the first connection part is fixedly connected to the top surface of side wall of the magnetic conduction base.

As an improvement, the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
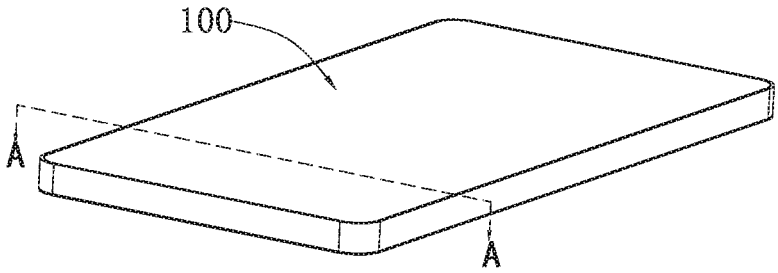
FIG. 1 is an isometric view of a screen sounding device in accordance with a first embodiment of the present invention.

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

In the description of the present invention, it should be noted that the azimuth or positional relationship indicated by terms like "center", "upper", "lower", "left", "right", "vertical", "horizontal", "inner", "outer", etc. is based on the azimuth or positional relationship shown in the drawings in order to facilitate the description of the present invention and simplify the description, rather than indicating or implying that the device or element referred to must have a specific orientation and be constructed in a specific orientation and operation. Therefore it cannot be understood as a limitation of the present invention. The terms "first", "second", and "third" are only used for descriptive purposes and cannot be understood as indicating or implying relative importance. In addition, unless otherwise clearly specified and defined, the terms "installation", "connected" "" and "connection" should be understood in a broad sense. For example, it can be a fixed connection, a detachable connection or an integral connection. It can also be a mechanical connection or an electrical connection. It can be directly connected or indirectly connected through an intermediary or the connection between two components. For those of ordinary skill in the field, the specific meanings of the above terms in the present invention can be understood in specific situations.

Figure 2A:
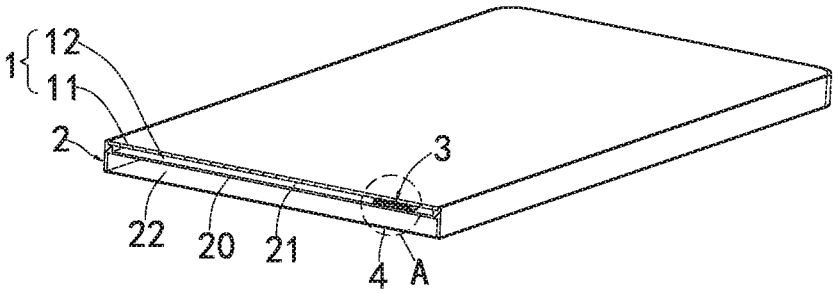
FIG. 2*a* is across-sectional view of the screen sounding device taken along line A-A in FIG. 1.
Figure 2B:
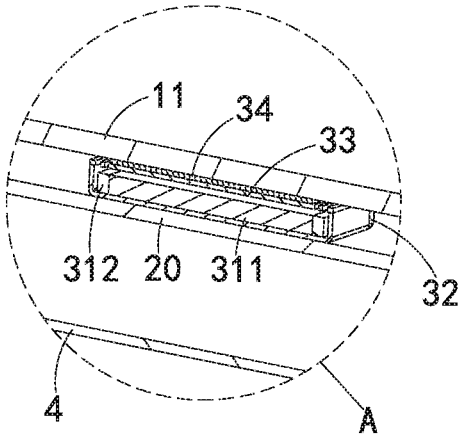
FIG. 2*b* is an enlarged view of Part A in FIG. 2*a;*
Figure 3:
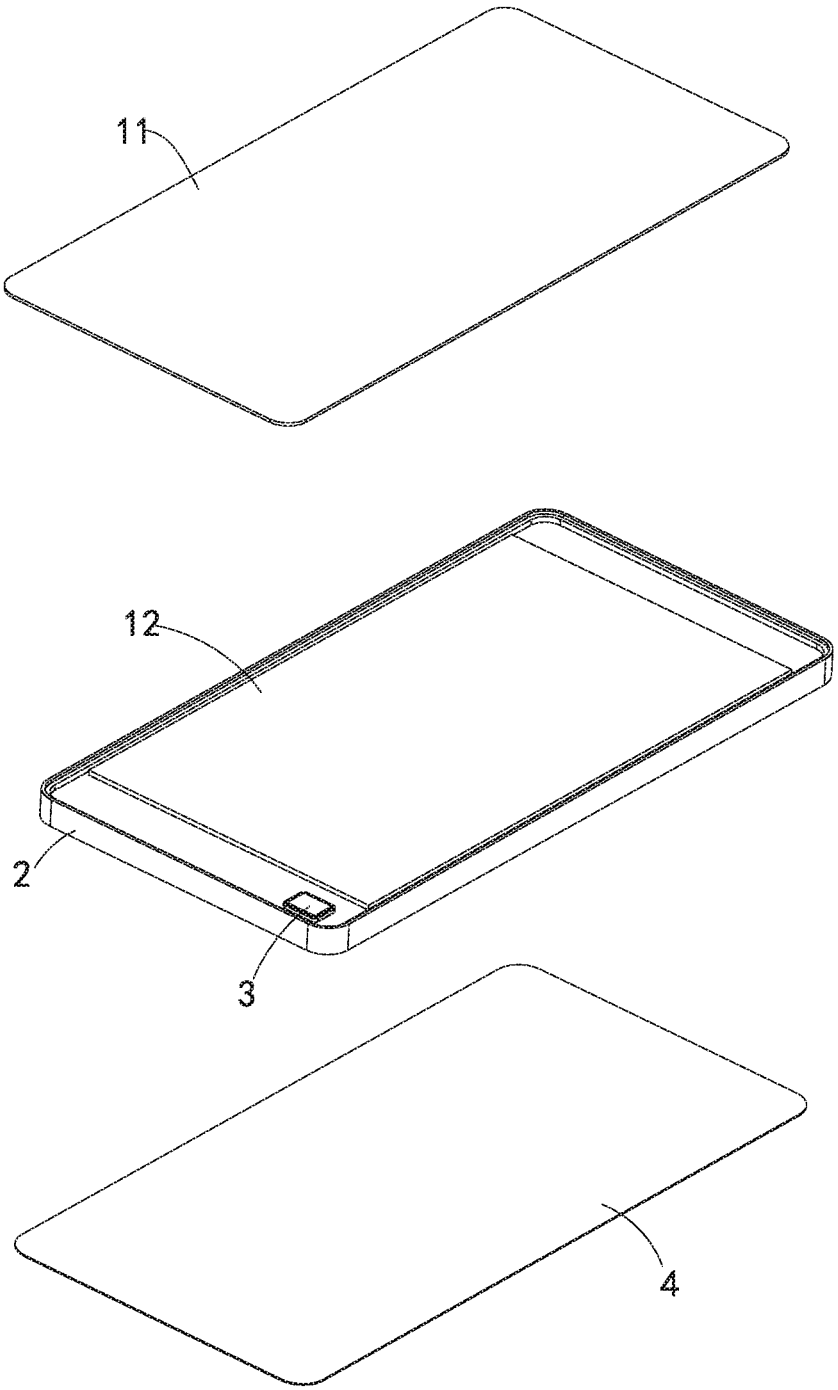
FIG. 3 is an exploded view of the screen sounding device in FIG. 1.

Please refer to FIGS. 1-3, which provides a screen sounding device 100 for this embodiment, including a screen 1 for vibration sound, a frame 2 for installing screen 1, an electromagnetic driving module 3 for driving the screen 1 to vibrate, and a back cover 4.

The frame 2 is a long middle frame with a middle division plate 20 in the middle. The middle division plate 20 divides the frame 2 into two upper spaces 21 and a lower space 22 spaced up and down. The electromagnetic driving module 3 is installed on the middle division plate 20 of the frame 2 and is placed in the upper space 21. The back cover 4 covers the lower space 22 of the frame 2.

The screen 1 includes a glass panel 11 and a display screen 12. The glass panel 11 and the display screen 12 are both installed on the frame 2. The glass panel 11 is stacked on the display screen 12. A length of the display screen 12 is smaller than a length of the glass panel 11. The electromagnetic driving module 3 is placed below the glass panel 11 and staggered with the display screen 12. In practical applications, the glass panel 11 may be a touch panel or only a general glass panel 11.

Figure 4:
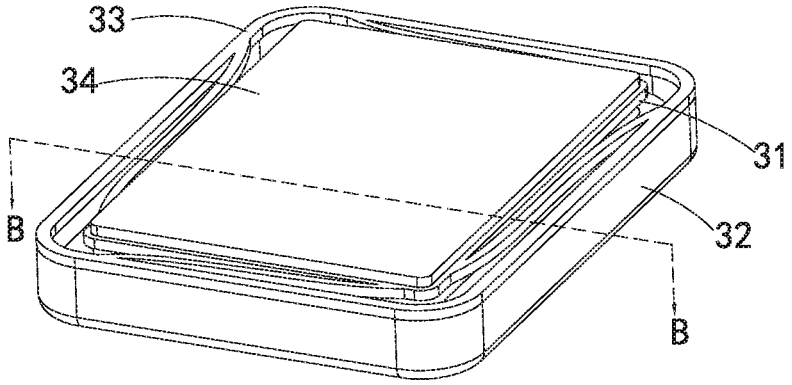
FIG. 4 is an isometric view of an electromagnetic driving module of the screen sounding device of the present invention.
Figure 5:
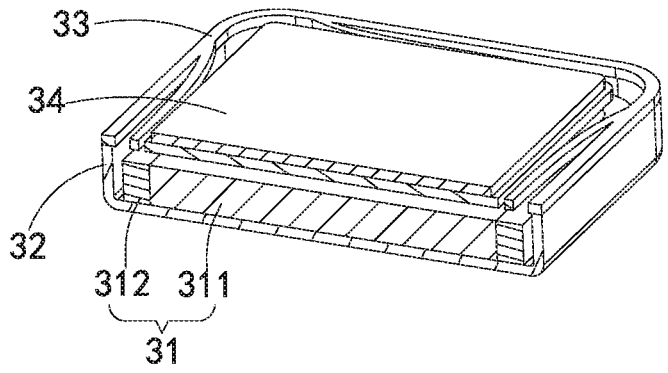
FIG. 5 is a cross-sectional view of the electromagnetic driving module taken along Line B-B in FIG. 4.
Figure 6:
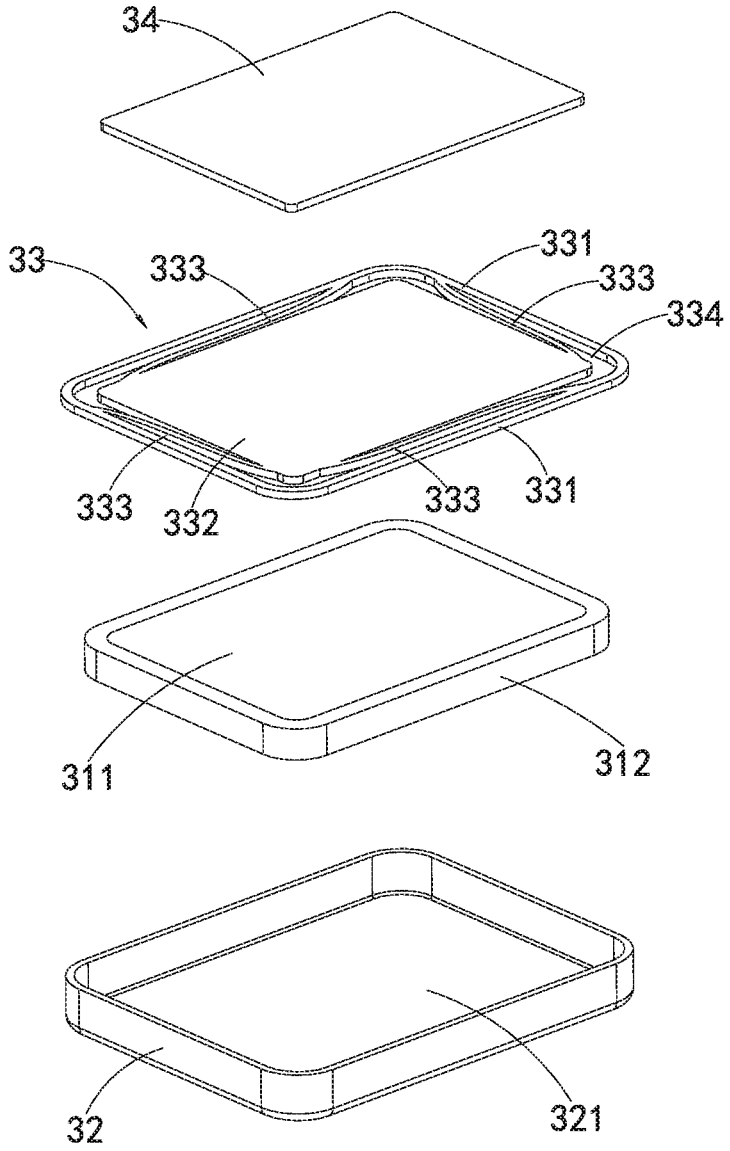
FIG. 6 is an exploded view of the electromagnetic driving module shown in FIG. 4.

Please refer to FIGS. 4-6, the above-mentioned electromagnetic driving module 3 includes an electromagnet 31, a magnetic conduction base 32 and a magnetic conduction covering plate 33. Wherein, the electromagnet 31 includes a magnetic core 311 and a coil 312 wound around an outer periphery of magnetic core 311. Both of the magnetic conduction base 32 and the magnetic conduction covering plate 33 are made of magnetic conduction material and have good magnetic permeability properties.

The magnetic conduction base 32 is provided with a cavity 321, and the cavity 321 of this embodiment is a slot with opening. The electromagnet 31 is fixedly installed in the cavity 321 of the magnetic conduction base 32. The magnetic conduction covering plate 33 covers and is placed at the opening of top part of the cavity 321.

The magnetic conduction covering plate 33 is provided with a first connection part 331, a second connection part 332, and a spring force arm 333. The spring force arm 333 is connected between the first connection part 331 and the second connection part 332. The first connection part 331 is fixedly connected with the top surface of side wall of the magnetic conduction base 32. The second connection part 332 is placed above the electromagnet 31, a gap is formed between the second connection part 332 and the electromagnet 31, and the second connection part 332 is fixed below the glass panel 11. The second connection part 332 can drive the glass panel 11 to vibrate and sound when it receives a force in a vertical direction.

In order to make the electromagnetic driving module better contact with the shield, the electromagnetic driving module of this embodiment also includes a connection plate 34. The connection plate 34 is stacked on the second connection part 332 of the magnetic conduction covering plate 33 and fixedly connected with the glass panel 11.

The magnetic conduction base 32 is arranged with multiple side walls, and the multiple side walls together form the cavity 321. A gap is formed between the inner side surface of the side wall and the coil 312 so as to avoid the contact between the coil 312 and the side wall of the magnetic conduction base 32. The transverse cross-section of the magnetic conduction base 32 of this embodiment is a rectangular, the transverse cross-section of the cavity in the magnetic conduction base 32 is also rectangular, and the magnetic conduction base 32 is arranged with four side walls.

Between the inner side surface of the first connection part 331 of the magnetic conduction covering plate 33 and the outer periphery of the second connection part 332, multiple interconnected deformation spaces 334 are arranged. A spring force arm 333 is arranged in each section of the deformation space 334. The second connection part 332 of this embodiment is overall in rectangular plate shape, the four sides thereof are respectively fixedly connected with the four inner side surfaces of the first connection part 331 through a spring form arm 333.

Preferably, the spring force arm 333 is in a long strip shape, and two ends thereof are respectively located at diagonal positions of the deformation space 334.

In the sounding device 100 of this embodiment, the electromagnet 31 can generate magnetic field after being electrified. Direction of the magnetic field and density of the magnetic field of the electromagnet 31 can be controlled by controlling the direction and magnitude of the electric current of the coil 312. The bottom surface of electromagnet 31 is fixedly connected with magnetic conduction base 32. Because the magnetic conduction base 32 itself has magnetic permeability characteristics, the magnetic conduction base 32 also has magnetism. Further, the magnetic conduction covering plate 33 fixedly connected to the magnetic conduction base 32 also has magnetism. Because the polarity of the top part of the electromagnet 31 is opposite to that of bottom part, but the polarity of the bottom part of the electromagnet 31 is the same as that of magnetic conduction covering plate 33, so the polarity of the top part of the electromagnet 31 is opposite to the polarity of magnetic conduction covering plate 33. The electromagnet 31 attracts the second connection part 332 of the magnetic conduction covering plate 33, intermittently powers on and realizes vibration. Because the second connection part 332 is fixedly connected to the screen 1, the second connection part 332 can drive screen 1 to vibrate, and then screen 1 generates sound. By changing the magnitude of the electric current flowing into the coil 312, the strength of the driving force can be controlled so as to provide a stronger driving force and obtain a better sound effect.

In addition, the electromagnetic driving module 3 of this implementation is connected by the magnetic conduction base 32 and the magnetic conduction covering plate 33 integrally, the structure is simple and installation is easy. At the same time, because the vibration amplitude of screen 1 is small, the entire sounding device can be made thin and the size can be smaller. Compared with the traditional speaker and receiver, the structure such as the diaphragm is omitted, and the production cost is lower.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A screen sounding device, including:

a screen for radiating sounding;

a frame for installing the screen;

an electromagnetic driving module for driving the screen to vibrate, including an electromagnet having a magnetic core and a coil wound around the outer periphery of the magnetic core, a magnetic conduction base and a magnetic conduction covering plate both made of magnetic conduction material; the magnetic conduction base being provided with a cavity; the electromagnet being fixedly installed in the cavity of the magnetic conduction base; wherein the magnetic conduction covering plate covers and is placed at an opening of a top part of the cavity;

the magnetic conduction covering plate includes a first connection part, a second connection part, and a spring force arm connected between the first and second connection parts;

the first connection part is fixedly connected to the magnetic conduction base; the second connection part is placed above the electromagnet and connected to the screen; and a gap is formed between the second connection part and the electromagnet.

2. The screen sounding device as described in claim 1, wherein the electromagnetic driving module includes a connection plate stacked on the second connection part of the magnetic conduction covering plate and fixedly connected to the screen.

3. The screen sounding device as described in claim 1, wherein the magnetic conduction base includes multiple side walls collectively surrounding and forming the cavity, and a gap is arranged between an inner side surface of the side wall and the coil.

4. The screen sounding device as described in claim 3 including multiple deformation spaces communicated with each other and located between an inner side surface of the first connection part and an outer periphery of the second connection part, wherein each of the deformation space accommodates one spring force arm.

5. The screen sounding device as described in claim 4, wherein the spring force arm is in a striped shape having two ends thereof respectively placed at diagonal positions of the deformation space.

6. The screen sounding device as described in claim 3, wherein the first connection part is fixedly connected to the top surface of side wall of the magnetic conduction base.

7. The screen sounding device as described in claim 1, wherein the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

8. The screen sounding device as described in claim 2, wherein the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

9. The screen sounding device as described in claim 3, wherein the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

10. The screen sounding device as described in claim 4, wherein the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

11. The screen sounding device as described in claim 5, wherein the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

12. The screen sounding device as described in claim 6, wherein the screen includes a glass panel and a display screen; the glass panel and the display screen are both installed on the frame, and the glass panel is stacked on the display screen; a length of the display screen is less than a length of the glass panel; the electromagnetic driving module is placed below the glass panel and avoids the display screen; the second connection part of the magnetic conduction covering plate is fixed below the glass panel.

* * * * *